US010203174B2

(12) United States Patent
Underwood

(10) Patent No.: US 10,203,174 B2
(45) **Date of Patent: *Feb. 12, 2019**

(54) CHARGING HANDLE WITH EXHAUST VENTILATION

(71) Applicant: AXTS, Inc., Redmond, OR (US)

(72) Inventor: Joshua A. Underwood, Salem, OR (US)

(73) Assignee: AXTS, INC., Redmond, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,237

(22) Filed: May 14, 2018

(65) Prior Publication Data

US 2018/0259277 A1 Sep. 13, 2018

Related U.S. Application Data

(63) Continuation of application No. 15/291,891, filed on Oct. 12, 2016, now Pat. No. 9,995,543.

(60) Provisional application No. 62/242,719, filed on Oct. 16, 2015.

(51) Int. Cl.
*F41A 3/72* (2006.01)
*F41A 13/00* (2006.01)

(52) U.S. Cl.
CPC ..... *F41A 3/72* (2013.01); *F41A 13/00* (2013.01)

(58) Field of Classification Search
CPC ..... F41A 3/72; F41A 13/00
USPC ..... 89/1.4
See application file for complete search history.

(56) References Cited

U.S. PATENT DOCUMENTS

| | | | | |
|---|---|---|---|---|
| 6,311,603 | B1 | 11/2001 | Dunlap | |
| 8,261,649 | B2 | 9/2012 | Fitzpatrick et al. | |
| 8,505,428 | B2 | 8/2013 | Overstreet | |
| 9,995,543 | B2 * | 6/2018 | Underwood | F41A 3/72 |
| 2011/0226120 | A1 | 9/2011 | Fitzpatrick | |
| 2013/0092014 | A1 | 4/2013 | Kincel | |

* cited by examiner

*Primary Examiner* — Jonathan C Weber
(74) *Attorney, Agent, or Firm* — Schwabe, Williamson & Wyatt, P.C.

(57) ABSTRACT

A charging handle includes a shaft, a front end that is operably coupled to a firearm bolt carrier, and a head that is located on an opposite end of the shaft from the front end. One or more ventilation features may be located in a first half of the length of the shaft proximate to the front end of the charging handle to prohibit exhaust that travels from the front end along the upper surface and/or side surfaces of the shaft from reaching the rear of the firearm and/or the head of the charging handle.

19 Claims, 14 Drawing Sheets

A - A

CHARGING HANDLE WITH EXHAUST VENTILATION

STATEMENT OF RELATED MATTERS

This application is a continuation of U.S. patent application Ser. No. 15/291,891, filed on Oct. 12, 2016, which claims priority to U.S. Provisional Application No. 62/242,719, filed on Oct. 16, 2015, the contents of which are herein incorporated by reference in their entirety.

BACKGROUND

Typical firearms propel a bullet or other type of projectile through the expansion of gas within a firearm barrel. The majority of the gas may be expelled out of the front of the firearm barrel together with the bullet. In certain types of firearms, such as automatic or semiautomatic firearms, a portion of the gas may be used to cycle the action of the firearm, thereby ejecting the used casing and reloading another round of ammunition into the firing chamber.

Additionally, firearms may be fitted with one or more firearm accessories such as a silencer or noise suppression device. The noise suppression device may operate to restrict, reduce or otherwise impeded the flow of the gas out the front of the barrel. Still other firearms may be designed and/or modified to have a shortened barrel. A firearm with a shortened barrel may also tend to be associated with an increased gas pressure.

An eye or another portion of the face of a user may be positioned behind the firearm substantially along the line of sight of the barrel. A portion of the gas which expands within the firearm but does not get exhausted out the front of the barrel may be blown back into the user's face.

Known firearm gas diversion systems such as U.S. Pat. Nos. 6,311,603, 8,261,649 and U.S. 2013/0092014 propose integrating a gas diversion feature near the rear portion of a charging handle, however a significant portion of the gas may nevertheless be expelled to the rear of the firearm and/or back into the user's face in these designs.

This application addresses these and other problems.

SUMMARY

A charging handle with exhaust ventilation is disclosed herein. The charging handle may comprise a shaft having a front end configured to operably couple the charging handle to a firearm bolt carrier. Additionally, a head may be located on an opposite end of the shaft from the front end, allowing the charging handle to be pulled to a rear of the firearm to charge the bolt carrier. One or more ventilation features may be located in a first half of the length of the shaft proximate to the front end of the charging handle. The one or more ventilation features may be configured to prohibit exhaust that travels from the front end along an upper surface and/or sides of the shaft from reaching the rear of the firearm and/or the head of the charging handle.

A method for ventilating firearm exhaust is disclosed herein. The method may comprise charging a firearm bolt carrier in response to a charging handle being pulled to the rear of the firearm. The charging handle may be located in an upper portion of a receiver. A round of ammunition may be chambered in a firing chamber, and gas within the firing chamber may be expanded to expel a projectile associated with the round of ammunition. Exhaust received from a portion of the expanding gas at a front end of a shaft of the charging handle may be generally directed from the front end of the shaft toward the rear of the firearm. The method may further comprise redirecting the exhaust from an upper surface and/or side surfaces of the charging handle down into the receiver. The exhaust may be redirected by one or more ventilation features located at the upper surface and/or side surfaces of the shaft in a first half of the charging handle located proximate to the front end.

DETAILED DESCRIPTION

Figure 1:
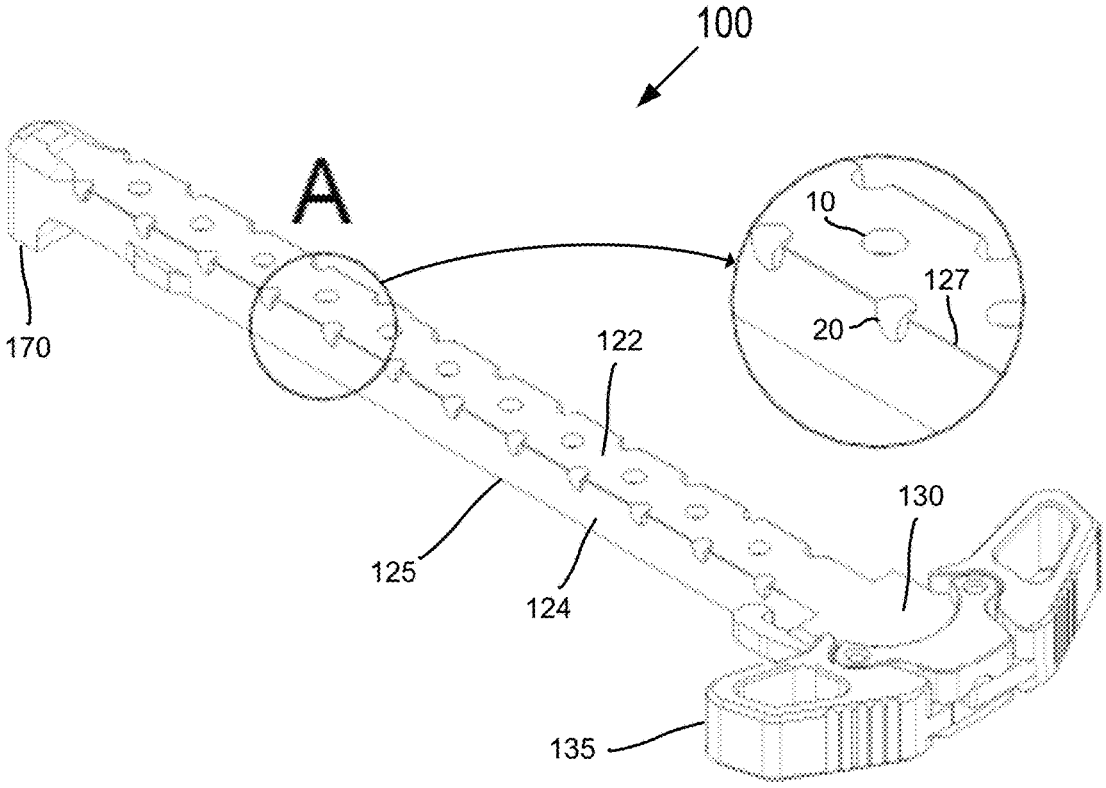
FIG. 1 illustrates an example charging handle with an exhaust ventilation system comprising a plurality of holes located substantially along the entire length of the top surface of the charging handle shaft.

FIG. 1 illustrates an isometric view of example charging handle 100 for a firearm, including an enlarged partial view A. The charging handle 100 may comprise an exhaust ventilation system including holes 10 located substantially along the entire length of the top or upper surface 122 of the charging handle shaft 125. Additionally, a number of holes 20 are shown being located at two edges 127 of the shaft 125. In some examples, the edges 127 may be beveled. In other examples, the edges 127 may not be beveled.

The shaft 125 may comprise an internal cavity that extends along substantially a length of the shaft 125 and may be configured to house at least a portion of a firearm bolt carrier. The upper surface 122 of the shaft 125 may be located on an opposite side of the shaft 125 as the internal cavity. Upper surface 122 may also extend along substantially the length of the shaft 125. A front end 170 of the charging handle 100 may be configured to operably couple the charging handle 100 to the firearm bolt carrier. Additionally, a head 130 of the charging handle may be located on an opposite end of the shaft 125 from the front end 170. The head 130 may comprise one or more handles 135 that may be configured to allow the charging handle 100 to be pulled to a rear of the firearm.

One or more ventilation features, such as holes 10 and/or holes 20 may be located in a first half of the length of the shaft 125 proximate to the front end 170 of the charging handle 100. The one or more ventilation features may be configured to prohibit exhaust that travels from the front end 170 along the upper surface 122 and/or sides 124 of the shaft 125 from reaching the rear of the firearm and/or the head 130 of the charging handle 100. In some examples, instead of including one or both of holes 10 and holes 20, the ventilation features may comprise similarly situated notches or dimples that may operate to redirect and/or impede the flow of exhaust towards the head 130 of the charging handle 100.

Figure 2A:
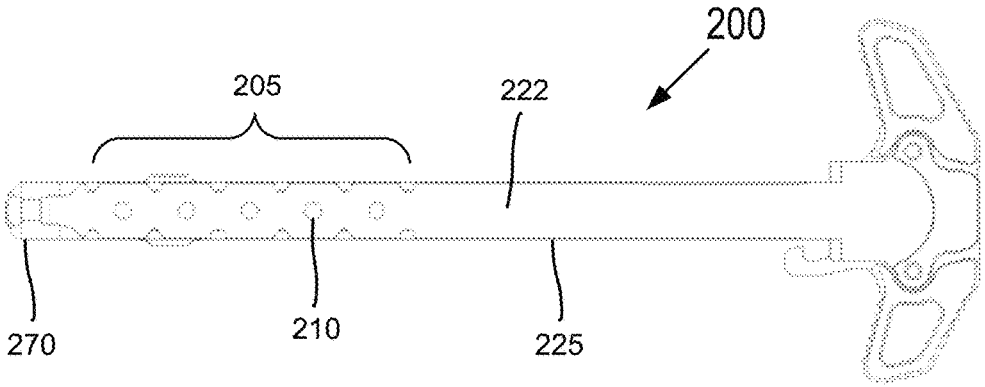
FIGS. 2A-2C illustrate an example charging handle with an exhaust ventilation system comprising holes located along a partial length of the charging handle shaft.
Figure 2B:
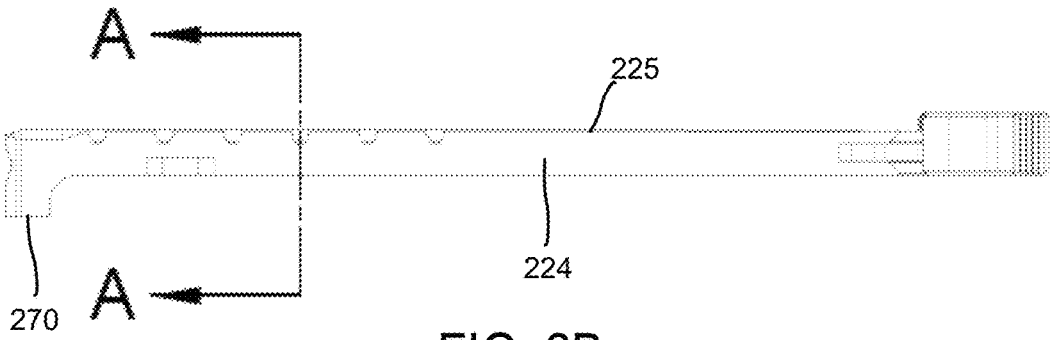
Figure 2C:
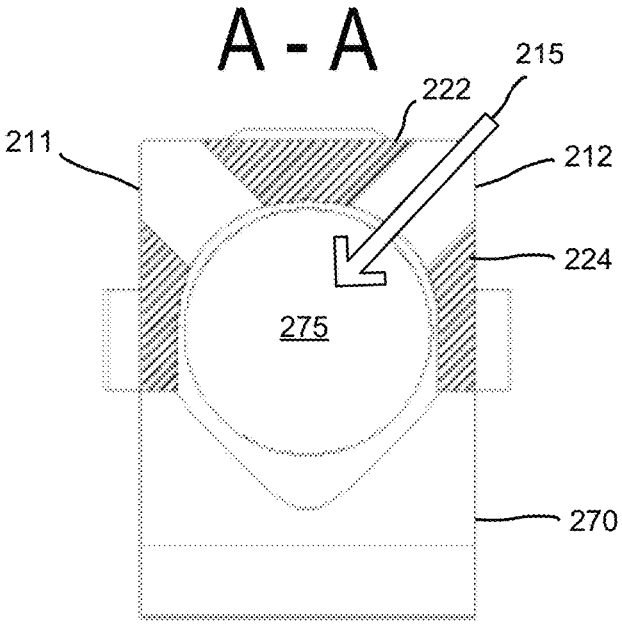

FIGS. 2A-2C illustrate an example charging handle 200 with an exhaust ventilation system comprising holes 210 located along a partial length 205 of the charging handle shaft 225. FIG. 2A illustrates a top view of the example charging handle 200, FIG. 2B illustrates a side view of the example charging handle 200, and FIG. 2C illustrates an enlarged cross-sectional view A-A of the example charging handle 200 taken through the side view. In some examples, the partial length 205 may be approximately half the overall length of the shaft 225. The partial length 205 may comprise a first half of the shaft 225 located proximate to a front end 270 of the charging handle 200.

The cross-sectional side view A-A of FIG. 2C taken through the shaft 225 illustrates a first hole 211 and a second hole 212 providing one or more passageways 215 from an upper surface 222 and/or a side surface 224 of the shaft 225 to a cavity 275 formed within the shaft 225. In some examples, cavity 275 may comprise a partial cavity or concave surface formed on the interior surface of the shaft 225.

As previously discussed, a round of ammunition may be chambered in a firing chamber in response to pulling the charging handle 200 to the rear of the firearm, and then releasing the charging handle 200. Gas within the firing chamber may be expanded to expel the bullet or projectile associated with the round of ammunition when the firearm trigger is pulled.

Exhaust received from a portion of the expanding gas at a front end 270 of the shaft 225 may be generally directed from the front end 270 toward the rear of the firearm. For example, the exhaust may be directed along the upper surface 222 and/or the side surfaces 224 of the shaft 225 toward the rear of the firearm. One or more of the holes 210 may be configured to redirect the exhaust from the upper surface 222 and/or side surfaces 224 of the shaft 225 into the one or more passageways 215. The passageways 215 may in turn be configured to direct the exhaust beneath the charging handle 200 into a lower receiver, where the exhaust may be diffused without reaching the rear of the firearm.

Figure 3A:
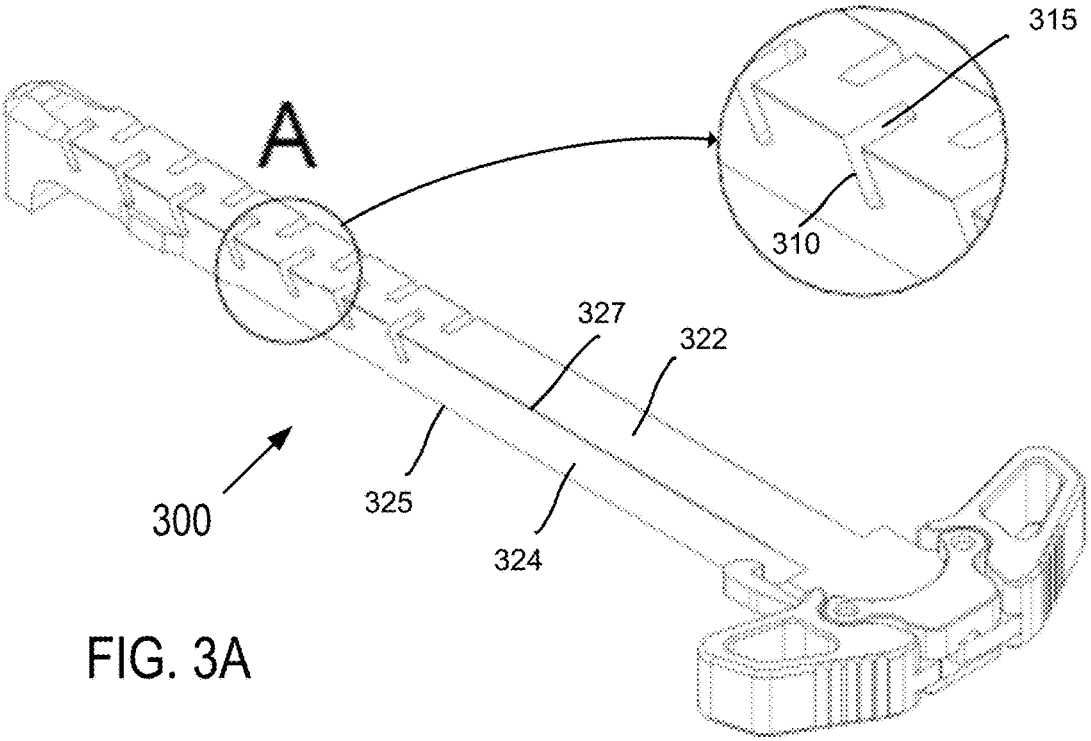
FIGS. 3A-3C illustrate an example charging handle with an exhaust ventilation system comprising staggered slots located along a partial length of the charging handle shaft.
Figure 3B:
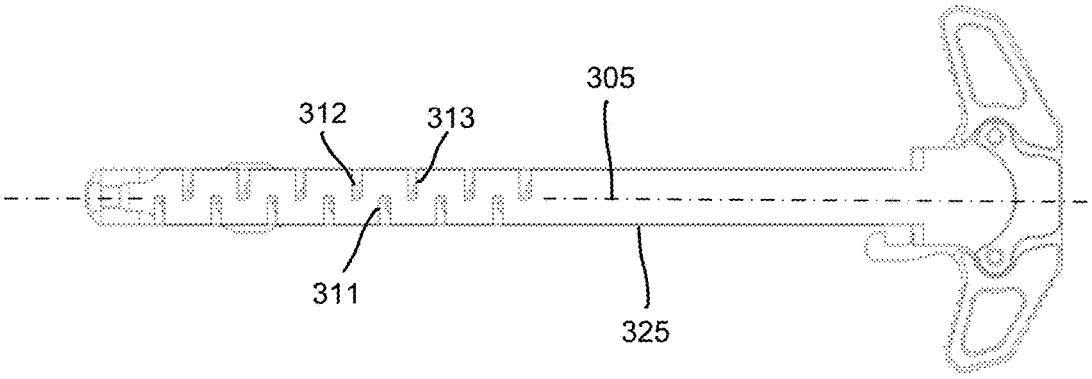
Figure 3C:
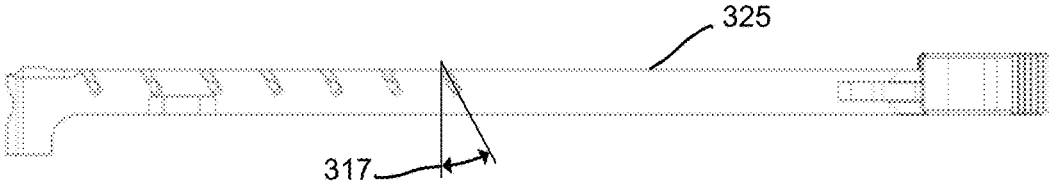

FIGS. 3A-3C illustrate an example charging handle 300 with an exhaust ventilation system comprising staggered slots 310 located along a partial length of the charging handle shaft 325. FIG. 3A illustrates an isometric view of the example charging handle 300 including an enlarged partial view A, FIG. 3B illustrates a top view of the example charging handle 300, and FIG. 3C illustrates a side view of the example charging handle 300. The slots 310 may be formed at one or more corners or edges 327 of the shaft 325, forming a passageway 315 from the upper surface 322 of the shaft 325 to one or more side surfaces 324 of the shaft 325.

In some examples, passageway 315 may be machined or otherwise formed in the upper surface 322 and/or side surface 324 without penetrating completely through the wall of the shaft 325. The passageway 315 may be configured to direct exhaust from the upper surface 322 to the side surface 324 of the shaft 325. Additionally, passageway 315 may be configured to direct the exhaust beneath the charging handle 300 in a generally downward direction. The portion of the slots 310 and/or passageway 315 formed in the side surface 224 of the shaft 325 may be angled or inclined from vertical. The angle of incline 317 may be ten to sixty degrees relative to vertical. For example, the angle of incline 317 may be approximately twenty degrees from vertical. In other examples, the angle of incline 317 may be approximately thirty degrees from vertical.

The slots 310 may be staggered along the length of the shaft 325, such that any one slot may be longitudinally located between two opposing slots. For example, a first slot 311 located on one side of the shaft 325 may be longitudinally located between a second slot 312 and a third slot 313. First slot 311 may form a passageway that extends from the approximate centerline 305 of the shaft 325 to a first side (e.g., a left side) of the shaft 325. On the other hand, second slot 312 and third slot 313 may each form a passageway that extends from the approximate centerline 305 of the shaft 325 to a second side (e.g., a right side) of the shaft 325. The slots 310 may be configured to redirect exhaust traveling along the upper surface 322 in a downward direction along both sides of the shaft 325, in an evenly distributed manner.

Figure 4:
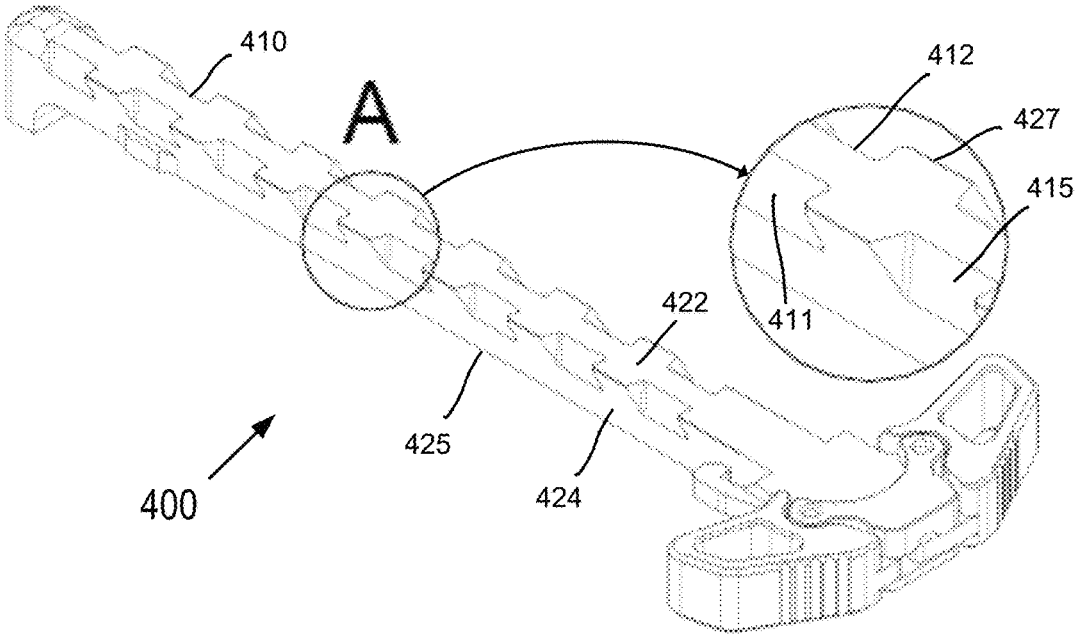
FIG. 4 illustrates an example charging handle with an exhaust ventilation system comprising compound slots located substantially along the entire length of the charging handle shaft.

FIG. 4 illustrates an example charging handle 400 with an exhaust ventilation system comprising compound slots 410 located substantially along the entire length of the charging handle shaft 425. FIG. 4 illustrates an isometric view of the example charging handle 400, and an enlarged partial view A of the example charging handle 400.

The compound slots 410 may comprise a first slot 411 located on a first side (e.g., a left side) of the shaft 425 and a second slot 412 located on a second side (e.g., a right side) of the shaft 425. Compound slots 410 may be configured to perform a similar function as slots 310, such as to redirect exhaust traveling along an upper surface 422 of the shaft 425 in a downward direction along both sides of the shaft 425. However, second slot 412 may be located directly across the upper surface 422 of the shaft 425 from first slot 411.

Compound slots 410 may comprise an angled notch removed from, or otherwise formed in, the corners or edges 427 of the shaft 425. One or more of the compound slots 410 may be configured to form passageway 415 from the upper surface 422 of the shaft 425 to one or more side surfaces 424 of the shaft 425.

Figure 5A:
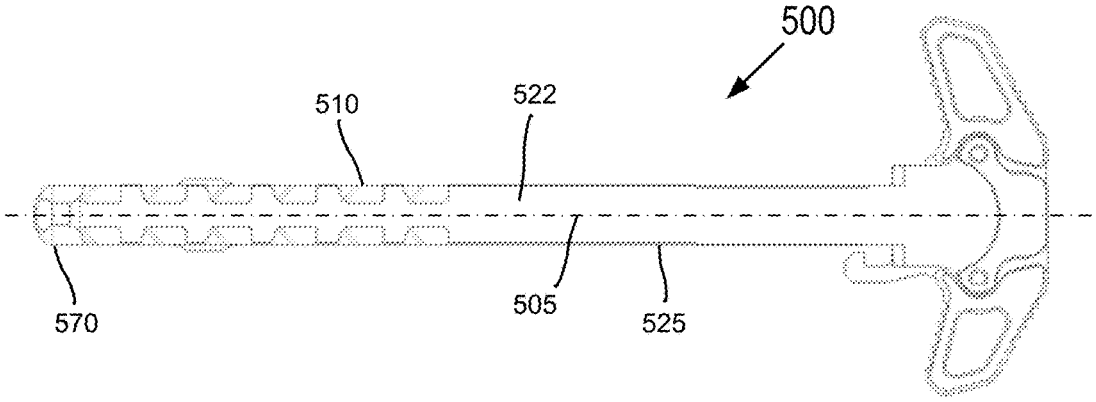
FIGS. 5A-5C illustrate an example charging handle with an exhaust ventilation system comprising compound slots located along a partial length of the charging handle shaft.
Figure 5B:
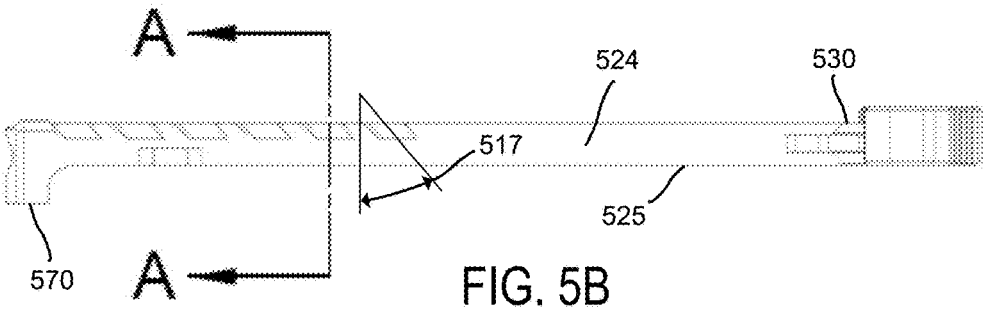
Figure 5C:
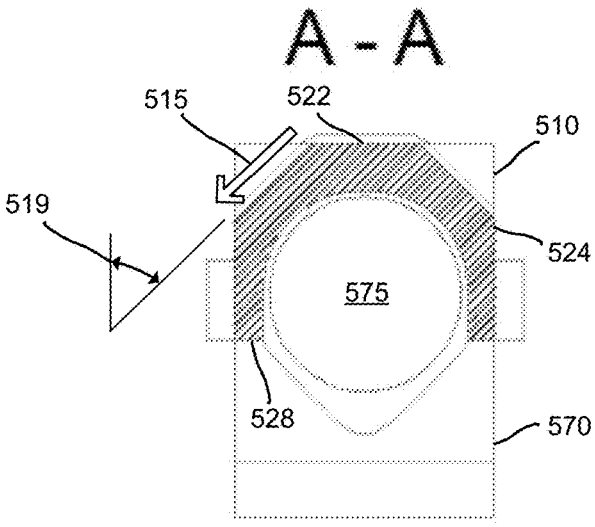

FIGS. 5A-5C illustrate an example charging handle 500 with an exhaust ventilation system comprising compound slots 510 located along a partial length of the charging handle shaft 525. FIG. 5A illustrates a top view of the example charging handle 500, FIG. 5B illustrates a side view of the example charging handle 500, and FIG. 5C illustrates an enlarged cross-sectional view A-A of the example charging handle 500 taken through the side view.

In some examples, the compound slots 510 may be identical to the example compound slots 410 illustrated in FIG. 4, however, compound slots 510 may only be located along the partial length, such as a first half of the shaft 525 located proximate to a front end 570 of the charging handle 500.

Compound slots 510 may be formed with multiple, or compound angles. For example, compound slot 510 may be machined or otherwise formed at a first angle 517 that may be configured to slant the side profile of the passageway 515 from the front end 570 of the shaft 525 towards the rear end 530 of shaft 525. Additionally, compound slot 510 may comprise a second angle 519 that may be configured to slant the front profile of the passageway 515 from the upper surface 522 of the shaft 525 to the side surface 524 of the shaft 525.

One or both of the first angle 517 and second angle 519 may be ten to forty-five degrees relative to vertical. For example, the first angle 517 may be approximately thirty degrees from vertical, and the second angle 519 may be approximately forty-five degrees from vertical. In some examples, second angle 519 may be greater than forty-five degrees from vertical, such as approximately sixty degrees from vertical.

The slots 510 may be machined or otherwise formed in the upper surface 522 and/or the side surfaces 524 so that one or more of the passageways 515 may not penetrate through the wall 528 of the shaft 525 into cavity 575. Slots 510 may be configured to redirect exhaust traveling along an upper surface 522 of the shaft 525 in a downward direction along both sides 524 of the shaft 525. Additionally one or more exhaust passageways 515 formed by the slots 510 on the upper surface 522 of the shaft 525 may not extend all the way to the centerline 505 of the shaft 525.

Figure 6:
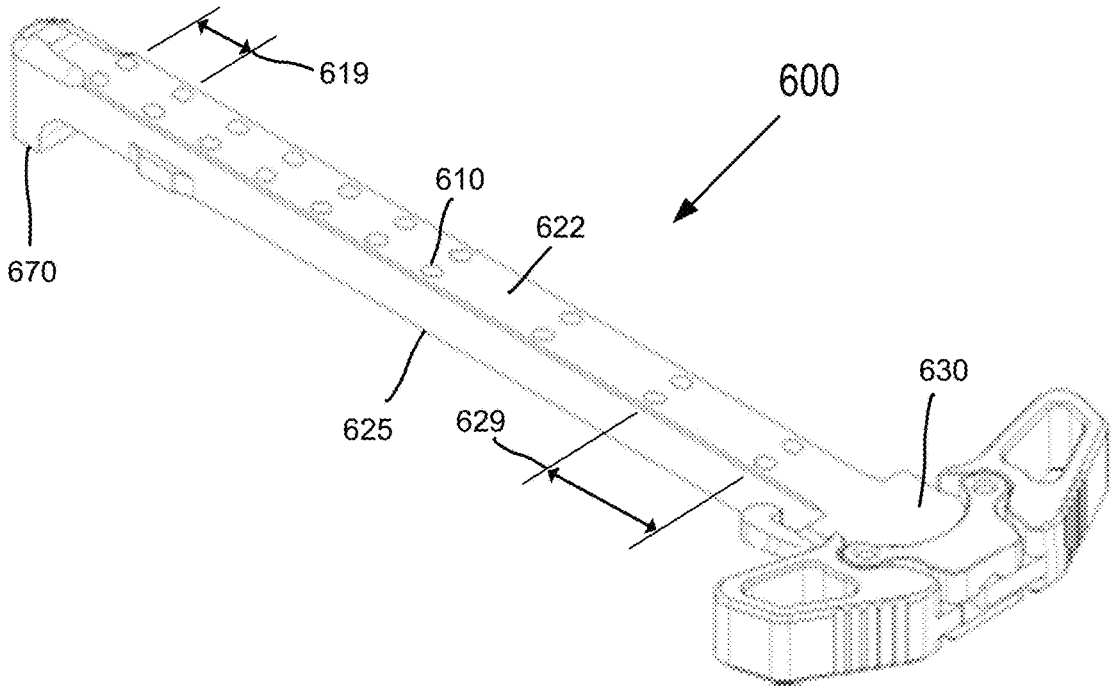
FIG. 6 illustrates an example charging handle with an exhaust ventilation system comprising holes located substantially along the entire length of the charging handle shaft.

FIG. 6 illustrates an example charging handle 600 with an exhaust ventilation system comprising holes 610 located substantially along the entire length of the charging handle shaft 625. The distance 619 between adjacent pairs of holes 610 may vary along the length of the shaft 625 to account for a diminished amount of exhaust that reaches subsequent pairs of holes. In some examples, the distance 619 between adjacent pairs of holes 610 at the front end 670 of the shaft 625 may be smaller than the distance 629 between adjacent pairs of holes at the rear end 630 of the shaft 625. In other examples, the holes 610 may be configured as pairs of holes evenly spaced along the length of the shaft 625.

In some examples, the holes 610 may penetrate through an upper surface 622 of the shaft 625 into a cavity configured to receive a firearm bolt carrier. One or more of the holes 610 may be configured to redirect exhaust from the upper surface 622 of the shaft 625 into the cavity and/or into a lower receiver, where the exhaust may be diffused without reaching the head 630 of the charging handle 600.

Figure 7A:
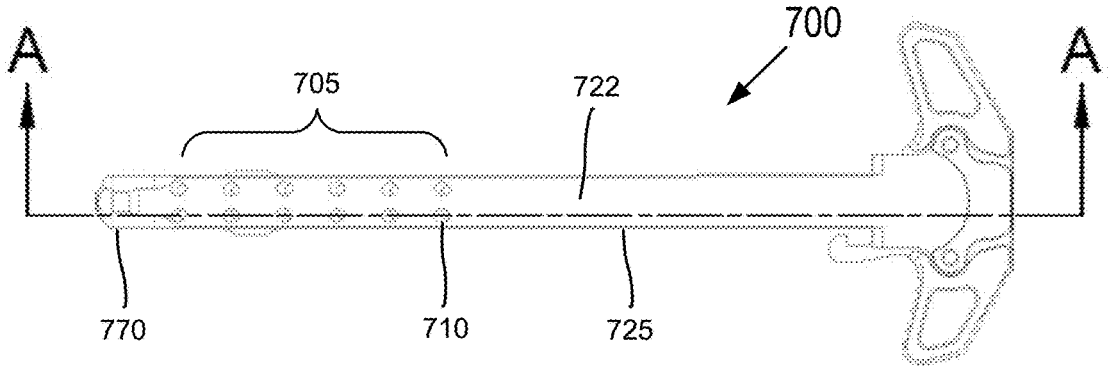
FIGS. 7A-7B illustrate an example charging handle with an exhaust ventilation system comprising holes located along a partial length of the charging handle shaft.
Figure 7B:
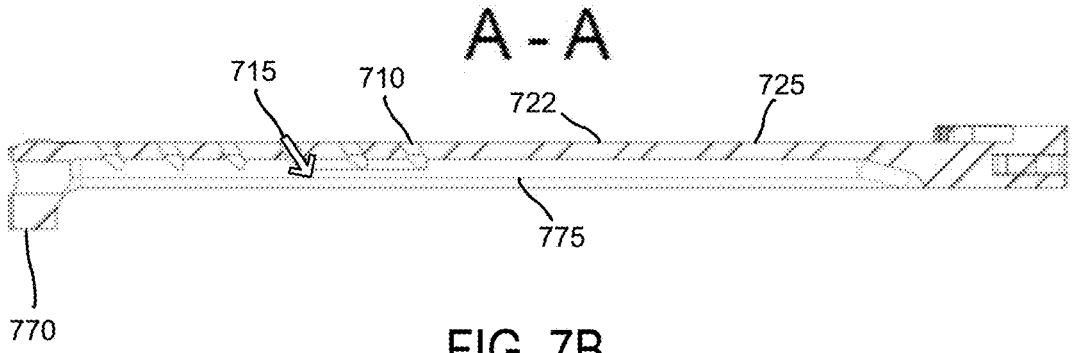

FIGS. 7A-7B illustrate an example charging handle 700 with an exhaust ventilation system comprising holes 710 located along a partial length 705 of the charging handle shaft 725. FIG. 7A illustrates a top view of the example charging handle 700 and FIG. 7B illustrates a cross-sectional side view A-A of the example charging handle 700. In some examples, the partial length 705 may be approximately half the overall length of the shaft 725. The partial length 705 may comprise a first half of the shaft 725 located proximate to a front end 770 of the charging handle 700.

The cross-sectional side view illustrates a cavity 775 formed on the interior surface of the shaft 725. The holes 710 may be configured to provide one or more passageways 715 from an upper surface 722 of the shaft 725 into the cavity 775. In some examples, cavity 775 may comprise a partial cavity or concave surface formed on the interior surface of the shaft 725.

Exhaust received at a front end 770 of the shaft 725 may be generally directed from the front end 770 toward the rear 730 of the charging handle 700. For example, the exhaust may be directed along the upper surface 722 of the shaft 725 toward the rear 730 of the charging handle 700. One or more of the holes 710 may be configured to redirect the exhaust from the upper surface 722 of the shaft 725 into the one or more passageways 715. The passageways 715 may in turn be configured to direct the exhaust beneath the charging handle 700 into the cavity 775 and/or into a lower receiver, where the exhaust may be diffused without reaching the rear 730 of the charging handle 700.

Figure 8:
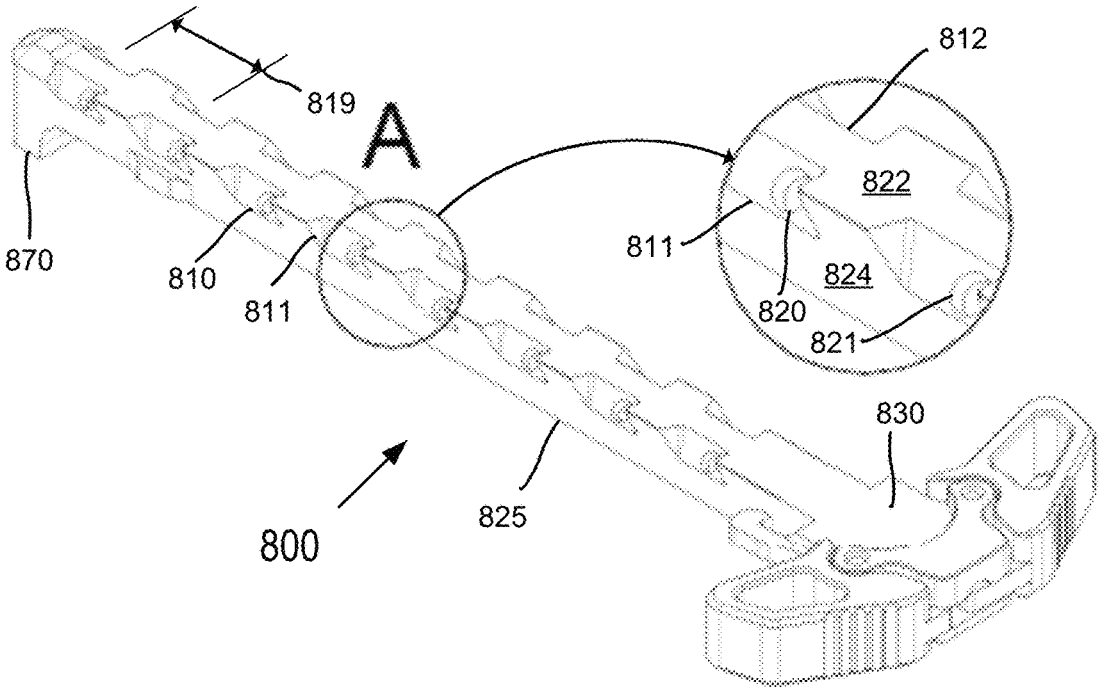
FIG. 8 illustrates an example charging handle with an exhaust ventilation system comprising compound slots and holes located substantially along the entire length of the charging handle shaft.

FIG. 8 illustrates an example charging handle 800 with an exhaust ventilation system comprising compound slots 810 with holes located substantially along the entire length of the charging handle shaft 825. FIG. 8 illustrates an isometric view of the example charging handle 800, and an enlarged partial view A of the example charging handle 800.

The compound slots 810 may comprise a first compound slot 811 located on a first side (e.g., a left side) of the shaft 825 and a second compound slot 812 located on a second side (e.g., a right side) of the shaft 825. The compound slots 810 may be configured as pairs of slots spaced along the length of the shaft 825. A distance 819 between adjacent slots, such as slots 810, 811, or between adjacent holes, such as holes 820, 821, may vary along the length of the shaft 825. Compound slots 810 may be configured to perform a similar function as compound slots 410, such as to redirect exhaust traveling along an upper surface 822 of the shaft 825 in a downward direction along both sides 824 of the shaft 825. Additionally, hole 820 may be located within one or more of the compound slots 810.

Figure 9A:
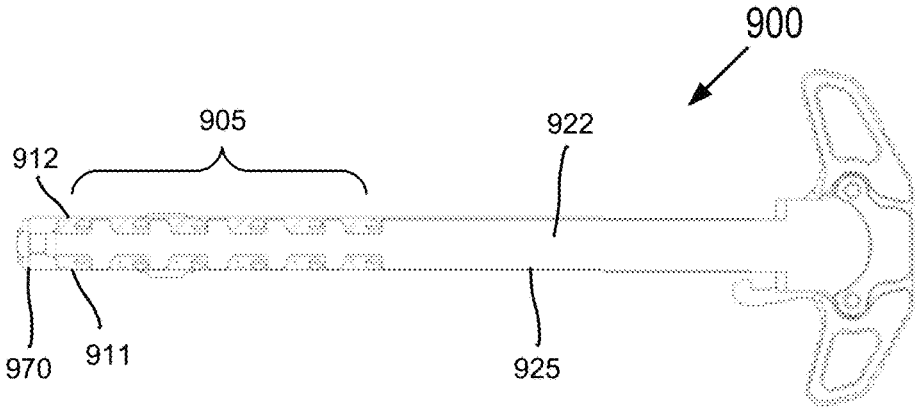
FIGS. 9A-9C illustrate an example charging handle with an exhaust ventilation system comprising compound slots and holes located along a partial length of the charging handle shaft.
Figure 9B:
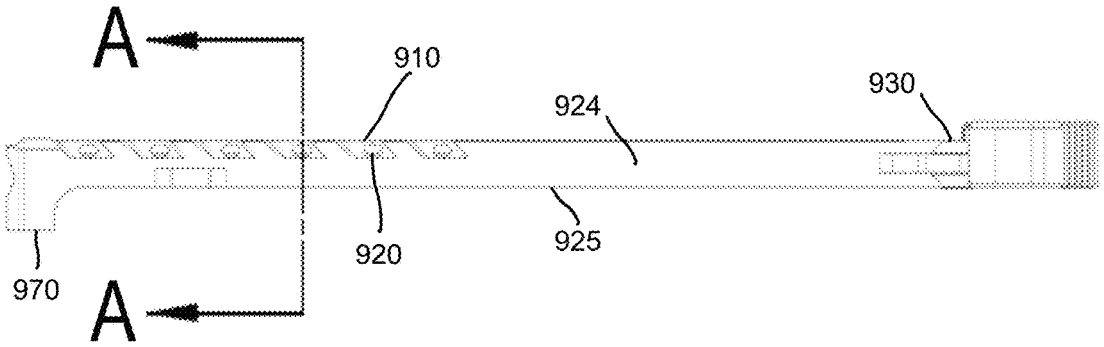
Figure 9C:
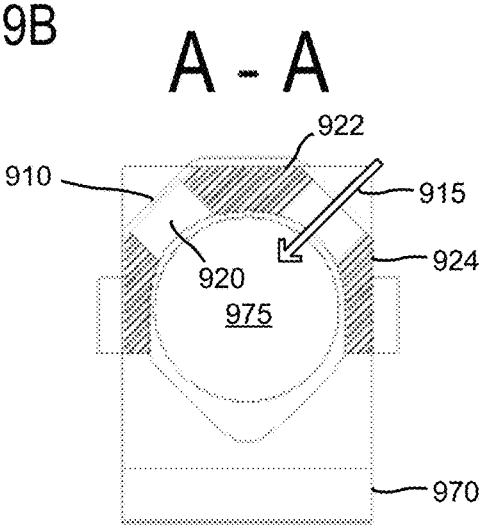

FIGS. 9A-9C illustrate an example charging handle with an exhaust ventilation system comprising compound slots with holes located along a partial length 905 of the charging handle shaft 925. FIG. 9A illustrates a top view of the example charging handle 900, FIG. 9B illustrates a side view of the example charging handle 900, and FIG. 9C illustrates an enlarged cross-sectional view A-A of the example charging handle 900 taken through the side view.

The compound slots may comprise a first compound slot 911 located on a first side (e.g., a left side) of the shaft 925 and a second compound slot 912 located on a second side (e.g., a right side) of the shaft 925. In some examples, the partial length 905 may be approximately half the overall length of the shaft 925. The partial length 905 may comprise a first half of the shaft 925 located proximate to a front end 970 of the charging handle 900.

The cross-sectional view A-A of FIG. 9C taken through the shaft 925 illustrates a compound slot 910 and hole 920 providing one or more passageways 915 from an upper surface 922 and/or a side surface 924 of the shaft 925 to a cavity 975 formed within the shaft 925. In some examples, cavity 975 may comprise a partial cavity or concave surface formed on the interior surface of the shaft 925.

Exhaust received at the front end 970 of the shaft 925 may be redirected from the upper surface 922 and/or side surfaces 924 of the shaft 925 into the one or more passageways 915. The passageways 915 may in turn be configured to direct the exhaust beneath the charging handle 900 into the cavity 975 and/or into a lower receiver, where the exhaust may be diffused without reaching the rear 930 of the charging handle 900.

Figure 10A:
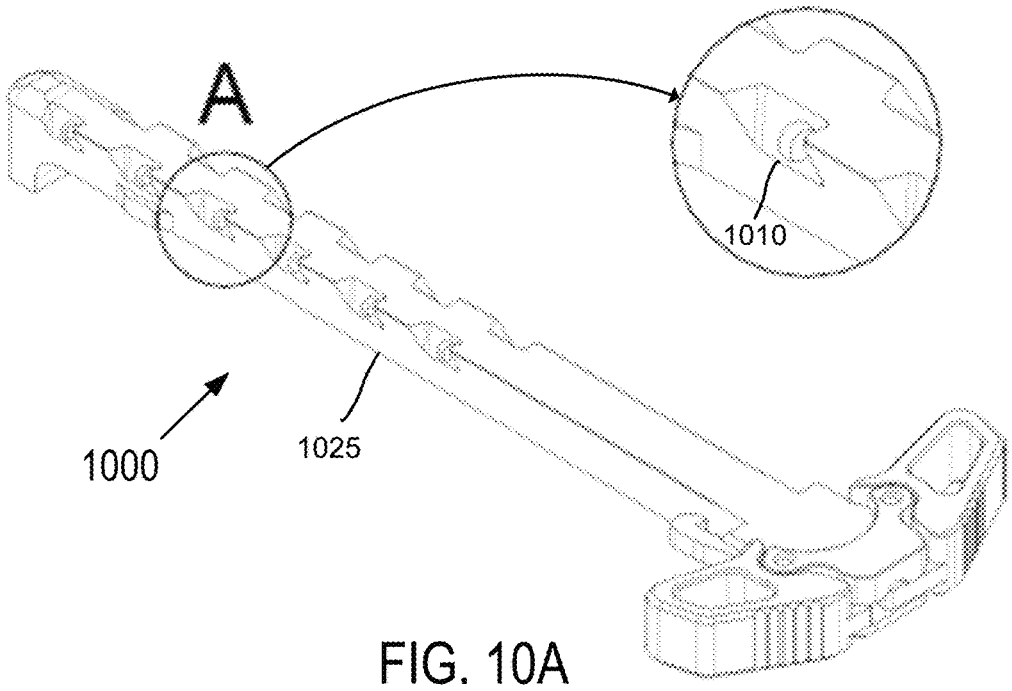
FIGS. 10A-10D illustrate an example charging handle with an exhaust ventilation system comprising offset compound slots and holes located on at least a partial length of the charging handle shaft.
Figure 10B:
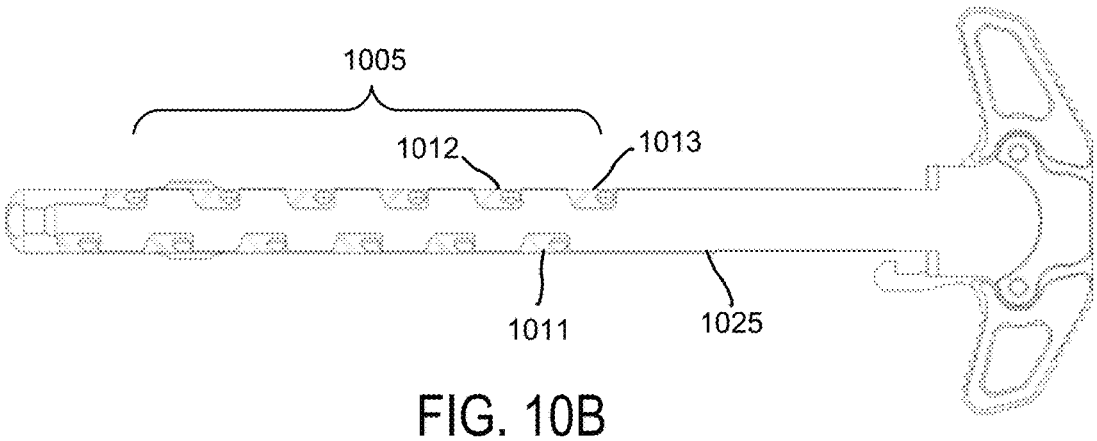
Figure 10C:
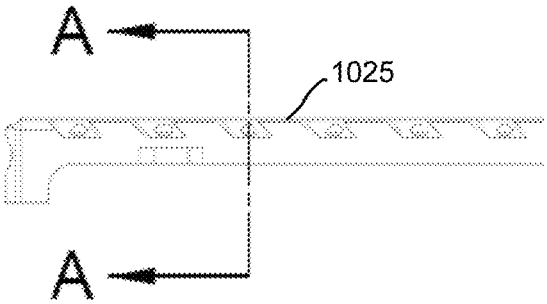
Figure 10D:
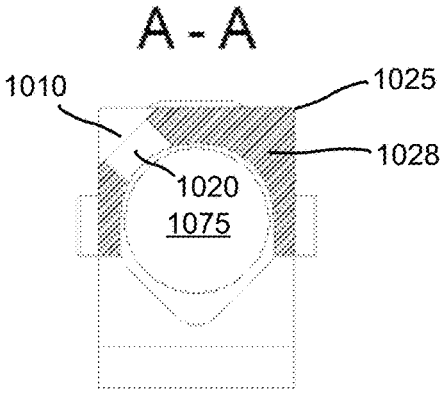

FIGS. 10A-10D illustrate an example charging handle 1000 with an exhaust ventilation system comprising offset compound slots 1010 and holes located on at least a partial length 1005 of the charging handle shaft 1025. FIG. 10A illustrates an isometric view of the example charging handle 1000 including an enlarged partial view A, FIG. 10B illustrates a top view of the example charging handle 1000, FIG. 10C illustrates a partial side view of the example charging handle 1000, and FIG. 10D illustrates an enlarged cross-sectional view A-A of the example charging handle 1000 taken through the side view.

In some examples, compound slots 1010 may be configured similarly as compound slots 910 (FIGS. 9B and 9C), except that one or more of compound slots 1010 may be staggered or offset from each other. The slots 1010 may be staggered along the length of the shaft 1025, such that any one slot may be longitudinally located between two opposing slots. For example, a first slot 1011 located on one side of the shaft 1025 may be longitudinally located between a second slot 1012 and a third slot 1013.

The cross-sectional view A-A of FIG. 10D illustrates a compound slot 1010 and hole 1020 providing a passageway into a cavity 1075 formed within the shaft 1025. Along the longitudinal length of the shaft 1025, there may be only one hole 1020 at any one given cross-sectional area, such that width or material associated with the sidewall 1028 of the shaft 1025 may be maximized or more evenly maintained over the partial length 1005, providing additional rigidity and strength to the shaft 1025.

Figure 11A:
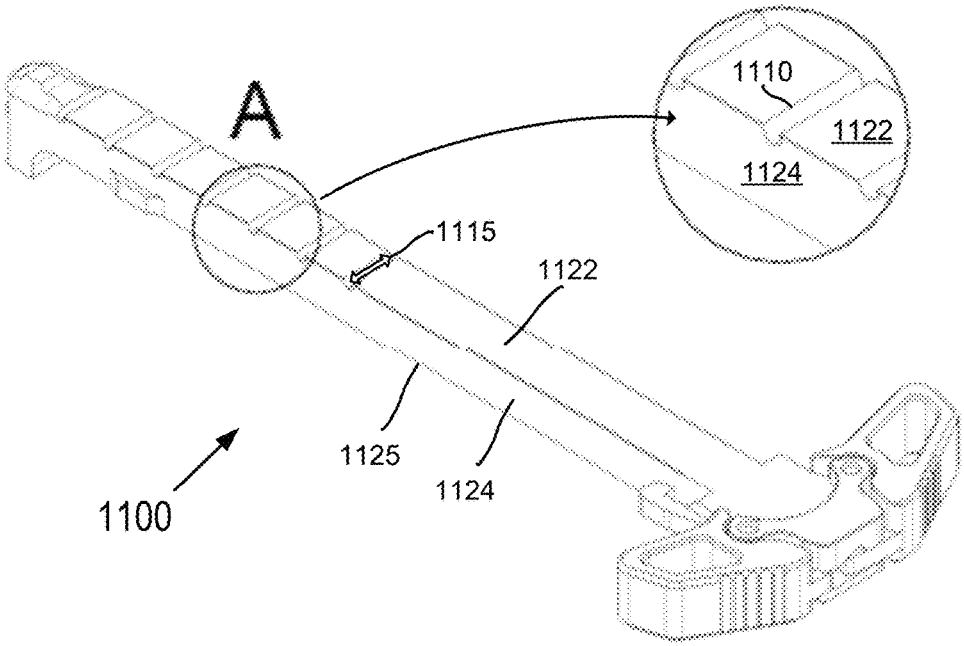
FIG. 11A-11C illustrate an example charging handle with an exhaust ventilation system comprising slots located on at least a partial length of the charging handle shaft.
Figure 11B:
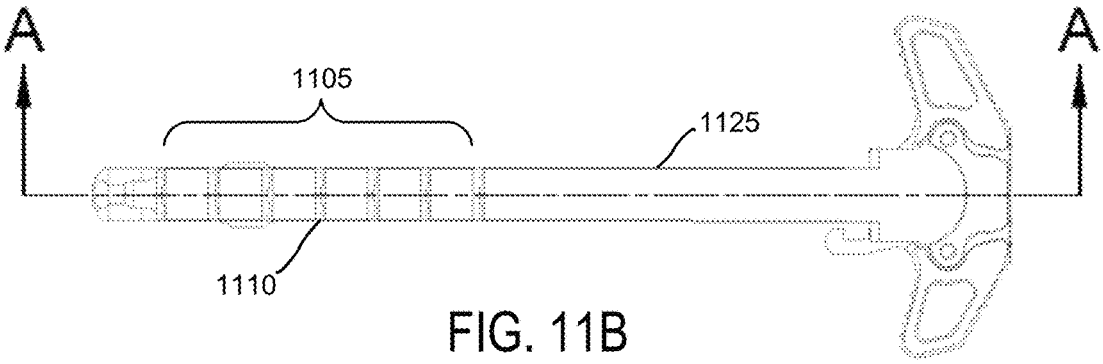
Figure 11C:
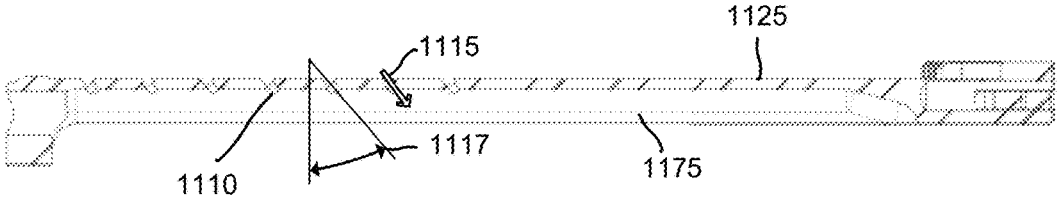

FIG. 11 illustrates an example charging handle 1100 with an exhaust ventilation system comprising slots 1110 located on at least a partial length 1105 of the charging handle shaft 1125. FIG. 11A illustrates an isometric view of the example charging handle 1100 including an enlarged partial view A, FIG. 11B illustrates a top view of the example charging handle 1100, and FIG. 11C illustrates a cross-sectional view A-A of the example charging handle 1100 taken through the top view.

The slots 1110 may be formed on an upper surface 1122 of the shaft 1125, forming a passageway 1115 between the side surfaces 1124 of the shaft 1125. Slot 1110 may form a passageway 1115 that extends from a first side (e.g., a left side) of the shaft 1125 to a second side (e.g., a right side) of the shaft 1125.

In some examples, passageway 1115 may be machined or otherwise formed in the upper surface 1122 and/or side surface 1124 without penetrating completely through the wall of the shaft 1125 into the cavity 1175. In other examples, passageways 1115 may penetrate through the wall of the shaft 1125 into the cavity 1175. The passageways 1115 may be configured to direct exhaust from the upper surface 1122 to the side surface 1124 of the shaft 1125. Additionally, passageway 1115 may be configured to direct the exhaust beneath the charging handle 1100 in a generally downward direction. In some examples, passageways 1115 may be configured to direct exhaust into the cavity 1175.

The passageway 1115 may be angled or inclined from vertical. The angle of incline 1117 may be ten to sixty degrees relative to vertical. For example, the angle of incline 1117 may be approximately twenty degrees from vertical. In other examples, the angle of incline 1117 may be approximately thirty degrees from vertical.

Figure 12:
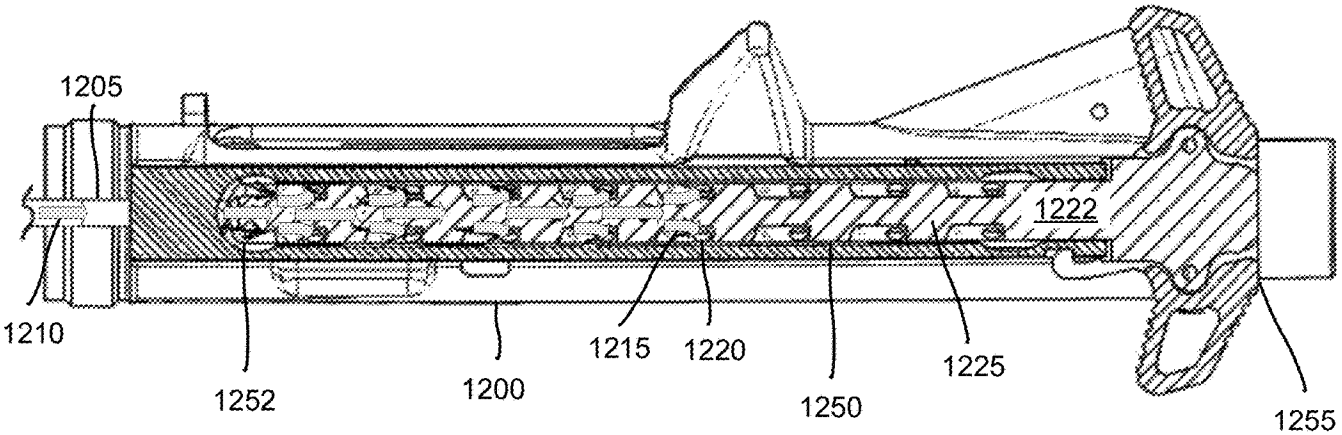
FIG. 12 illustrates a top view of an example charging handle mounted in a firearm, illustrating example gas flow.

FIG. 12 illustrates a top view of an example charging handle 1250 mounted in a firearm 1200 and illustrating example gas flow. In some examples, pulling the charging handle 1250 to the rear of the firearm 1200 and releasing it causes a firearm bolt carrier to be charged and a round of ammunition to be chambered into a firing chamber. In other examples, the firearm bolt carrier may be charged by simply pulling back a charging handle or by other means known in the art.

After the trigger of the firearm 1200 is pulled, gas located within the firing chamber expands to expel the bullet or projectile associated with the round of ammunition from the firearm 1200. Initially gas flow or exhaust 1210 passes through a gas tube 1205 of the firearm 1200 to cycle the bolt carrier. A portion of the expanding gas is received at a front end 1252 of a shaft 1225 of the charging handle 1250 as exhaust 1210. The exhaust 1210 is generally directed from the front end 1252 of the shaft 1225 toward the head or rear 1255 of the charging handle 1250. The rear end 1255 may be located on an opposite end of the shaft 1225 from the front end 1252, and may be configured for pulling the charging handle 1250 to the rear of the firearm 1200. Releasing the charging handle 1250 may operate to charge the bolt carrier.

The exhaust 1210 may be redirected from a top surface of the charging handle 1250 down through one or more ventilation features 1220 located at the upper surface 1222 of the shaft 1225 in a first half of the charging handle 1250 located proximate to the front end 1252 of the shaft. The one or more ventilation features 1220 may comprise a plurality of ventilation features located along substantially the entire first half of the length of the shaft 1225. In some examples, the one or more ventilation features 1220 may comprise a plurality of ventilation features located along substantially the entire length of the shaft 1225. Additionally, the upper surface 1222 may extend along substantially the entire length of the shaft 1225.

One or more of the ventilation features 1220 may be located in a first half of the length of the shaft 1225 proximate to the front end of the charging handle. The one or more ventilation features 1220 may be configured to prohibit exhaust that travels from the front end 1252 along the upper surface 1222 and/or side surfaces of the shaft 1225 from reaching the rear of the firearm or the rear end 1255 of the charging handle 1250. The one or more ventilation features 1220 may be located at the upper surface 1122 and/or the side surfaces of the shaft 1225. Additionally, the one or more ventilation features comprise a set of two ventilation features located on either side of a longitudinal centerline of the upper surface.

In some examples, two beveled edges located on either side of the top surface 1222 of the shaft 1225 may extend along the length of the shaft 1225, and a set of two ventilation features may be located at the two beveled edges. The set of two ventilation features may comprise two channels that extend from the top surface to the beveled edges. Additionally, the two channels may further extend from the beveled edges down along either side of the shaft 1225. In some examples, the set of two ventilation features may comprise two recesses formed in the beveled edges. The two recesses may penetrate through the beveled edges into an internal cavity of the shaft 1225.

Figure 13:
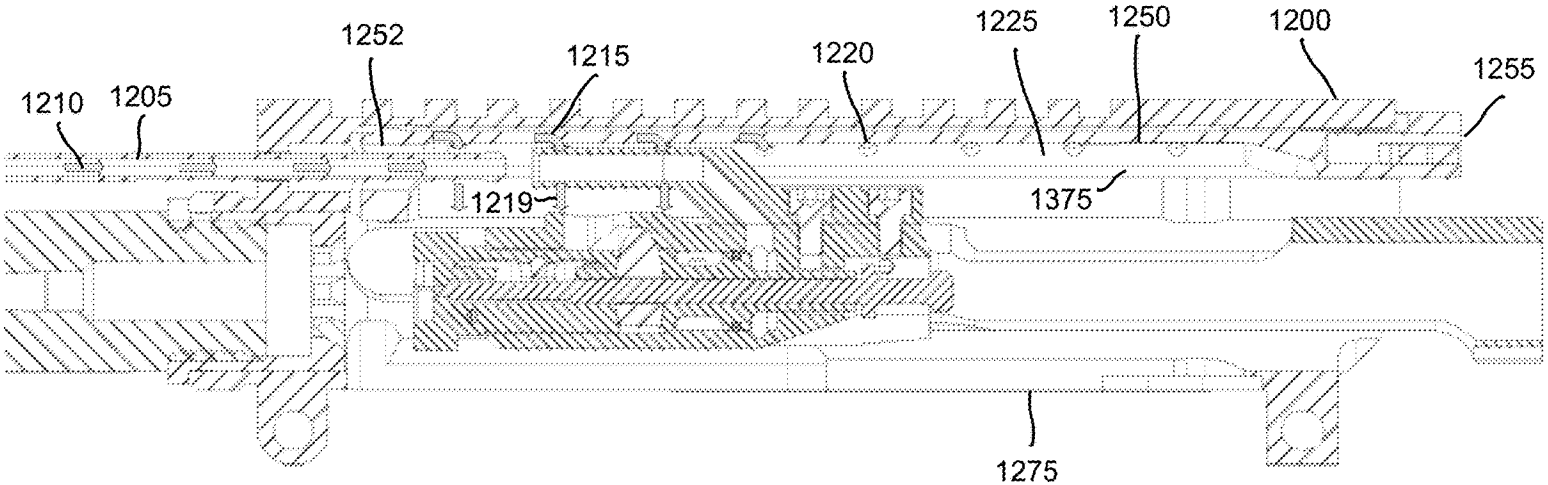
FIG. 13 illustrates a cross-sectional view of the firearm of FIG. 12.

FIG. 13 illustrates a cross-sectional view of the firearm 1200 of FIG. 12 illustrating example gas flow from the charging handle 1250 into a receiver 1275 of the firearm 1200. The charging handle 1250 may be located within an upper portion of the receiver 1275.

The exhaust 1210 may be redirected 1215, 1219 from an upper surface of the charging handle 1250 down into the main body of the receiver 1275. The exhaust 1210 may be redirected by one or more ventilation features 1220 located at a top surface of the shaft 1225 in a first half of the charging handle 1250 located proximate to the front end 1252 of the shaft. In some examples, exhaust 1210 may be redirected by one or more ventilation features located at one or more side surfaces of the shaft 1225 of the charging handle. By redirecting the exhaust 1210 into the main body of the receiver 1275, gas flow into the user's face at the rear 1255 of the charging handle 1250 may be greatly reduced and/or eliminated.

Shaft 1225 may comprise an internal cavity 1375 that extends along the length of the shaft 1225 and is configured to house at least a portion of a firearm bolt carrier. In some examples, the internal cavity 1375 may extend along substantially the entire length of the shaft 1225. The upper surface of the shaft 1225 (FIG. 12) is located on an opposite side of the shaft 1225 as the internal cavity 1375.

The one or more ventilation features 1220 may comprise a channel configured to direct the exhaust from the upper surface 1222 down the outside of the shaft 1225 and into the surrounding receiver 1275 of the firearm 1200. The channel may be formed in the shaft 1225 by making a groove in the upper surface 1222. In some examples, the channel may extend from the upper surface 1222 to a side wall of the shaft 1225. Additionally, the channel may comprise a compound groove having two or more angles of incline.

The one or more ventilation features 1220 may comprise a recess that extends at least partially into the upper surface 1222 of the shaft 1225. The recess may penetrate through the upper surface 1222 of the shaft 1225 into the internal cavity 1375. Additionally, the recess may be configured to direct the exhaust from the upper surface 1222 down into the internal cavity 1375 and into the receiver 1275.

Figure 14:
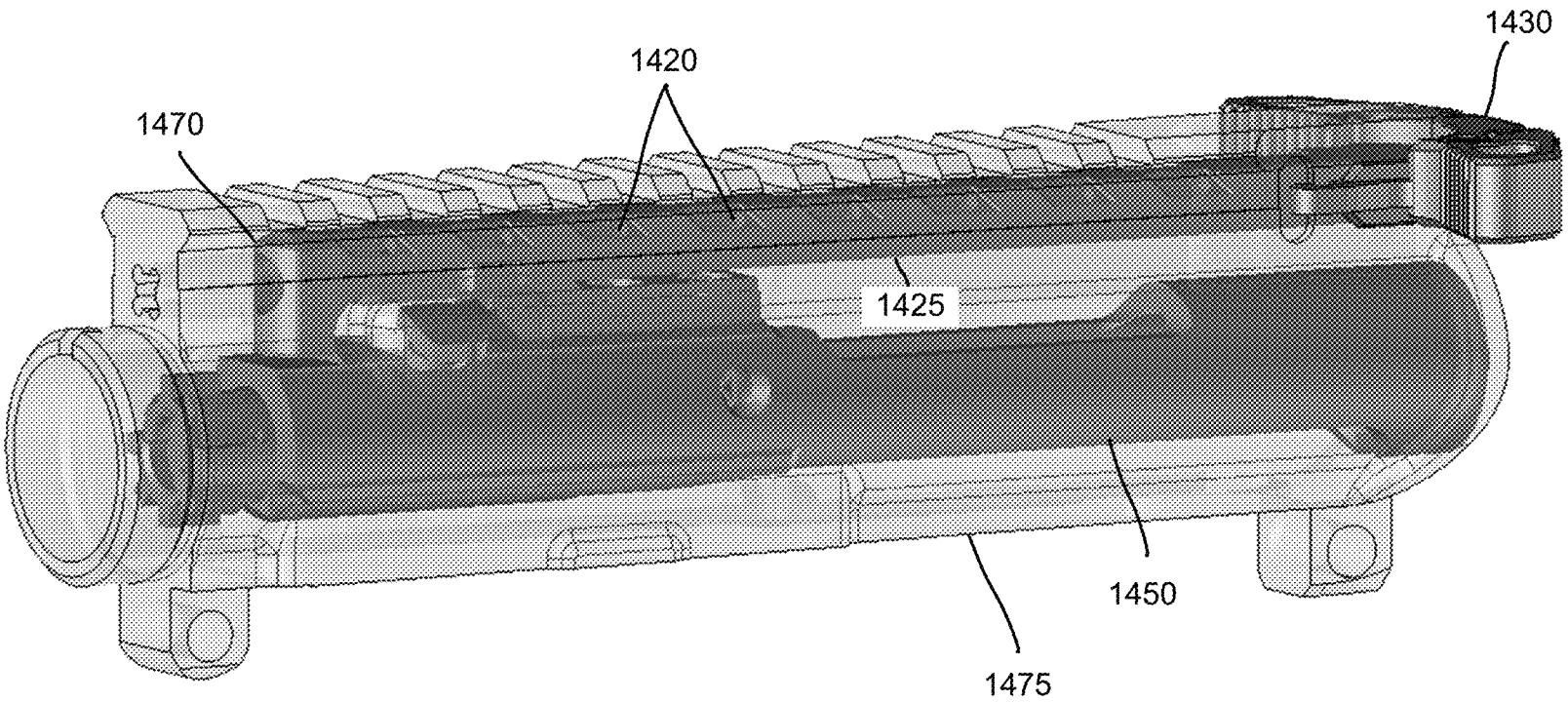
FIG. 14 illustrates an example charging handle mounted in a receiver, shown in a transparent view.

FIG. 14 illustrates an example charging handle 1425 inside of a receiver 1475, shown in a transparent view. The charging handle 1425 comprises a number of ventilation features 1420 which may be configured to redirect exhaust traveling from a front end 1470 of the charging handle 1425 to a rear end 1430 of the charging handle 1425, such that the exhaust may be redirected and/or diffused into the body of the receiver 1475 without reaching the rear end 1430.

Charging handle 1425 may be configured to house at least a portion of a firearm bolt carrier 1450. The front end 1470 of the charging handle 1425 may be configured to operably couple the charging handle 1425 to the firearm bolt carrier 1450. Additionally, one or more handles located at the rear end 1430 may be configured to pull the charging handle 1425 to the rear of the firearm. The bolt carrier 1450 may be charged when the charging handle 1425 is released.

Figure 15:
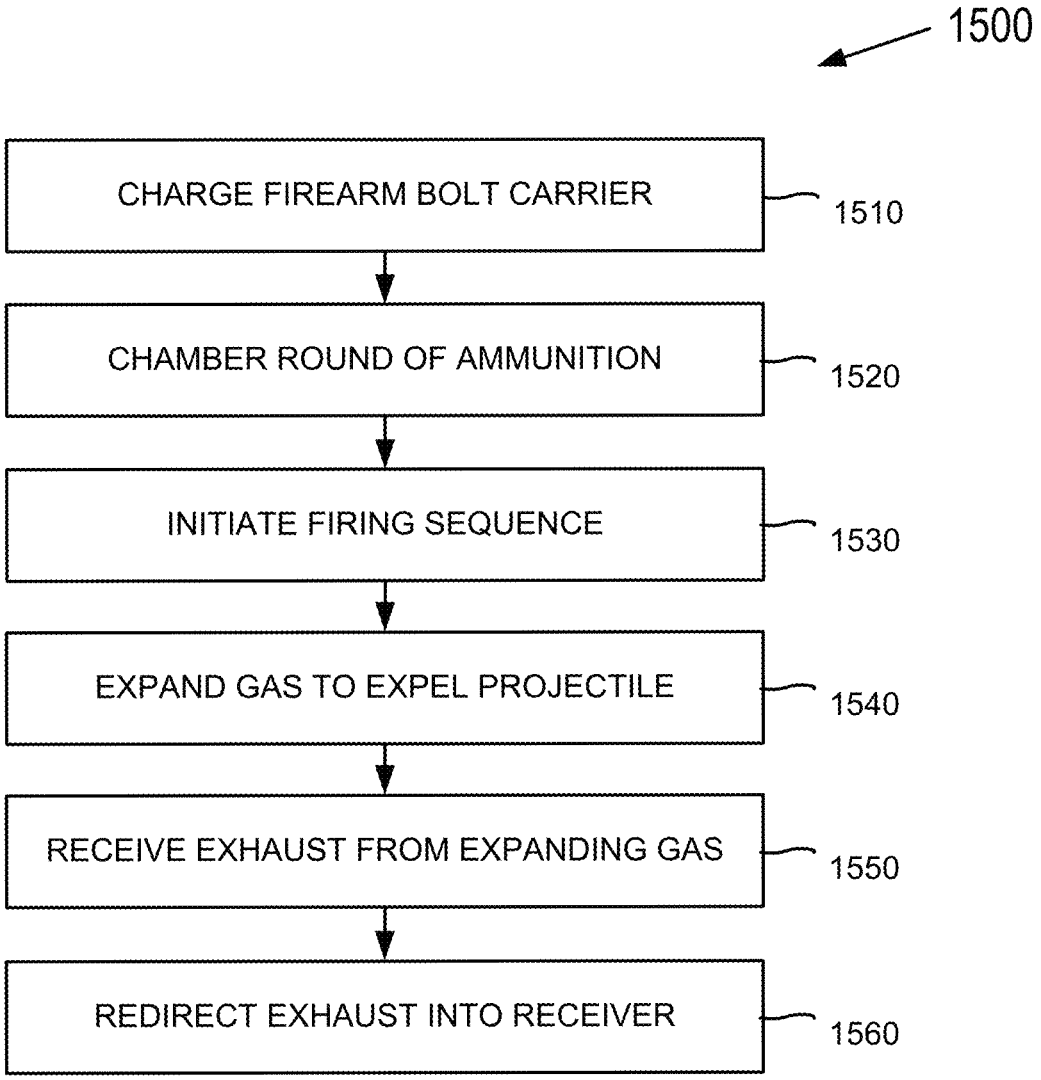
FIG. 15 illustrates a process of ventilating firearm exhaust.

FIG. 15 illustrates a process 1500 of ventilating firearm exhaust. At operation 1510, a firearm bolt carrier is charged in response to a charging handle being pulled to the rear of the firearm. The charging handle may be at least partially located within a receiver of the firearm.

At operation 1520, a round of ammunition may be chambered in a firing chamber.

At operation 1530, a firing sequence of the firearm may be initiated, such as by pulling a firearm trigger.

At operation 1540, gas located in the firing chamber may expand to expel a bullet or projectile associated with the round of ammunition.

At operation 1550, exhaust from a portion of the expanding gas may be received at a front end of a shaft of the charging handle, and the exhaust may be generally directed from the front end of the shaft toward the rear of the firearm.

At operation 1560, the exhaust may be redirected from an upper surface and/or side surfaces of the charging handle down into the main body of the receiver. The exhaust may be redirected by one or more ventilation features located at the upper surface and/or the side surfaces of the shaft in at least a first half of the charging handle located proximate to the front end of the shaft.

While some of the examples have been illustrated or described with respect to providing functionality for a rifle, some or all of the features may also be enabled for operation with other types of firearms including, but not limited to, a hand-gun.

Having described and illustrated various examples herein, it should be apparent that other examples may be modified in arrangement and detail. We claim all modifications and variations coming within the spirit and scope of the following claims.

The invention claimed is:

1. A charging handle, comprising:

a shaft having an upper surface and side surfaces that extend along a length of the shaft between a first end of the shaft and a second end of the shaft;

an internal cavity located between the first and second ends, wherein the upper surface is located on an opposite side of the shaft as the internal cavity;

a front end located at the first end, the front end configured to operably couple the charging handle to a firearm;

one or more projections located at the second end, the projections configured to allow the charging handle to be pulled to charge the firearm; and one or more ventilation features provided in the upper surface and/or in the side surfaces, wherein at least one of the one or more ventilation features penetrates through the shaft into the internal cavity, the one or more ventilation features configured to impede a flow of firearm discharge exhaust gases along the upper surface and/or side surfaces from moving towards the one or more projections and/or redirect the flow of the firearm discharge exhaust gases away from the one or more projections.

2. The charging handle of claim 1, wherein the one or more ventilation features comprise plural ventilation features.

3. The charging handle of claim 2, wherein the plural ventilation features are staggered on either side of a longitudinal centerline of the upper surface.

4. The charging handle of claim 1, wherein the one or more ventilation features comprise a channel in the upper surface, the channel configured to direct the exhaust gases from the upper surface to at least one of the side surfaces.

5. The charging handle of claim 4, wherein the channel comprises a compound groove having two or more angles of incline.

6. The charging handle of claim 4, wherein the channel extends from the upper surface to at least one of the side surfaces.

7. The charging handle of claim 1, wherein the one or more ventilation features comprise a recess that extends at least partially into the upper surface.

8. The charging handle of claim 7, wherein the recess penetrates through the upper surface into the internal cavity.

9. The charging handle of claim 8, wherein the recess is configured to direct the exhaust gases from the upper surface down into the internal cavity and away from the one or more projections.

10. The charging handle of claim 9, wherein the one or more ventilation features further comprise a channel located at the upper surface and configured to direct the exhaust gases into the recess.

11. The charging handle of claim 1, wherein the one or more ventilation features comprise plural ventilation features, wherein one of the plural ventilation features is located on a different side of a longitudinal centerline of the upper surface than another one of the plural ventilation features.

12. The charging handle of claim 1, further comprising beveled edges along the length of the shaft between the upper surface and the side surfaces, respectively, wherein the one or more ventilation features comprise plural ventilation features, wherein at least one of the plural ventilation features is located on a different one of the beveled edges than at least another one of the plural ventilation features.

13. The charging handle of claim 12, wherein the plural ventilation features extend from the upper surface to the beveled edges, respectively.

14. The charging handle of claim 13, wherein the plural ventilation features further extend down along the side surfaces of the shaft, respectively.

15. The charging handle of claim 12, wherein the plural ventilation features comprise recesses formed in the beveled edges, respectively.

16. The charging handle of claim 15, wherein the recesses penetrate through the beveled edges, respectively, into the internal cavity.

17. A firearm, comprising:

one or more features that restrict, reduce, or otherwise impede a flow of firearm discharge exhaust gases out of a muzzle of the firearm; and a charging handle to at least partially compensate for gas pressure associated with the one or more features, the charging handle including:

a shaft having an upper surface and side surfaces that extend along a length of the shaft between a first end of the shaft and a second end of the shaft;

an internal cavity located between the first and second ends, wherein the upper surface is located on an opposite side of the shaft as the internal cavity;

a front end located at the first end, the front end configured to operably couple the charging handle to the firearm;

one or more projections located at the second end, the one or more projections configured to allow the charging handle to be pulled to charge the firearm; and one or more ventilation features provided in the upper surface and/or in the side surfaces, wherein at least one of the one or more ventilation features penetrates through the shaft into the internal cavity, the one or more ventilation features configured to impede a flow of firearm discharge exhaust gases along the upper surface and/or side surfaces from moving towards the one or more projections and/or redirect the flow of the firearm discharge exhaust gases away from the one or more projections.

18. The firearm of claim 17, wherein the firearm comprises a long gun.

19. The firearm of claim 17, wherein the firearm comprises a handgun.

* * * * *